US009351068B2

(12) United States Patent
Slupeiks et al.

(10) Patent No.: US 9,351,068 B2
(45) Date of Patent: May 24, 2016

(54) OBSTRUCTED PORT AUDIO SIGNAL ALTERATION

(71) Applicant: Research In Motion Limited, Waterloo (CA)

(72) Inventors: Jason Lance Slupeiks, Waterloo (CA); Nathan Robert Webster, Woodstock (CA); Sidi El Becaye Maiga, Kitchener (CA)

(73) Assignee: BlackBerry Limited, Waterloo, Ontario (CA)

( * ) Notice: Subject to any disclaimer, the term of this patent is extended or adjusted under 35 U.S.C. 154(b) by 232 days.

(21) Appl. No.: 13/918,010

(22) Filed: Jun. 14, 2013

(65) Prior Publication Data

US 2014/0369512 A1 Dec. 18, 2014

(51) Int. Cl.

*H04R 29/00* (2006.01)
*H04R 3/00* (2006.01)
*H04R 5/04* (2006.01)

(52) U.S. Cl.

CPC .. *H04R 3/00* (2013.01); *H04R 5/04* (2013.01); *H04R 2430/01* (2013.01); *H04R 2499/11* (2013.01)

(58) Field of Classification Search

CPC ..... H04R 2430/01; H04R 19/005; H04R 2460/03; H04R 2499/11; H04R 29/001; H04R 3/00; H04R 3/04; H04R 5/04; H04B 17/373; H04B 17/3913; H04M 1/03; H04M 1/6016; H04M 2250/12

USPC ..... 381/55–59, 96, 98, 89, 333, 345, 111, 381/377; 181/148, 175, 198, 199

See application file for complete search history.

(56) References Cited

U.S. PATENT DOCUMENTS 5,461,676 A * 10/1995 Hobelsberger ..... 381/96
6,639,987 B2 * 10/2003 McIntosh ..... 381/71.6

(Continued)

FOREIGN PATENT DOCUMENTS

EP 1174732 6/2001
EP 1244279 9/2002

(Continued)

OTHER PUBLICATIONS

European Search Report dated Oct. 23, 2013 for European Application No. 13172163.1.

*Primary Examiner* — Lun-See Lao

(74) *Attorney, Agent, or Firm* — Jon Gibbons; Fleit Gibbons Gutman Bongini & Bianco P.L.

(57) ABSTRACT

A portable electronic device has an acoustic port having an aperture in a housing having a speaker and pressure sensing transducer incorporated therein. During normal use of the portable electronic device, the aperture of the acoustic port may become obstructed during handling, holstering or surface placement, resulting in reduced sound quality and a waste of energy from a battery powering the device. The pressure sensing transducer detects an obstruction of the acoustic port by detecting an increase in acoustic pressure within the housing or within an acoustic chamber coupling the aperture of the acoustic port to the speaker. In response, acoustic characteristics of the obstructed port speaker's audio are altered to conserve power or enhance audio. Furthermore, acoustic characteristics of speakers of unobstructed acoustic port apertures of the device may also be altered in response to detection of the obstruction.

9 Claims, 5 Drawing Sheets

(56) References Cited

U.S. PATENT DOCUMENTS

| | | | | |
|---|---|---|---|---|
| 2010/0189269 | A1 | 7/2010 | Haartsen et al. | |
| 2010/0322430 | A1 * | 12/2010 | Isberg | 381/58 |
| 2012/0128190 | A1 * | 5/2012 | Tam | 381/346 |

FOREIGN PATENT DOCUMENTS

| | | | | |
|---|---|---|---|---|
| EP | 1174732 | * | 1/2015 | G01S 15/04 |
| WO | 2005062581 | | 7/2005 | |

* cited by examiner

OBSTRUCTED PORT AUDIO SIGNAL ALTERATION

The present disclosure generally relates to audio signal processing and more particularly to altering audio in response to an obstructed acoustic port.

BACKGROUND

Portable or handheld audio devices include speakers for producing audio content including alerts, voice and music. Such audio devices include cell phones, smartphones, e-readers, gaming devices, tablets, and personal computers. Speakers are enclosed within a housing having a small acoustic port for protecting the speakers from the external environment while allowing audio to radiate from an aperture in the acoustic port. Such devices may also have multiple speakers to enhance the audio radiated by the device, each speaker having an associated acoustic port.

Handheld or portable devices can also include a pressure sensing transducer, such as a barometer, for measuring atmospheric pressure and providing a user of the device information such as altitude and weather status. A barometer may be enclosed within the housing and use an aperture to provide for sensing of atmospheric pressure.

Handheld or portable devices are exposed to a number of differing environments during their use. Such environments includes being held by a hand of the user, being retained in a casing such as a holster or folio, or being placed on a surface in any of a number of orientations. Exposure to these differing environments may result in a blocking, smothering or an obstructing of an acoustic port and a corresponding degradation in audio radiated by the device. For example, a user holding a smartphone may inadvertently cover a port while holding the phone, or may lay the phone on a surface obstructing the port, or may retain the phone in a holster or folio that does not facilitate the port. These examples result in a blocking of the port and a degradation of audio performance. Also, this results in a waste of power as the energy used to drive the speaker does not result in anticipated audio performance.

BRIEF DESCRIPTION OF THE DRAWINGS

The accompanying figures where like reference numerals refer to identical or functionally similar elements throughout the separate views, and which together with the detailed description below are incorporated in and form part of the specification, serve to further illustrate various embodiments and to explain various principles and advantages all in accordance with the present disclosure, in which.

DETAILED DESCRIPTION

Figure 1:
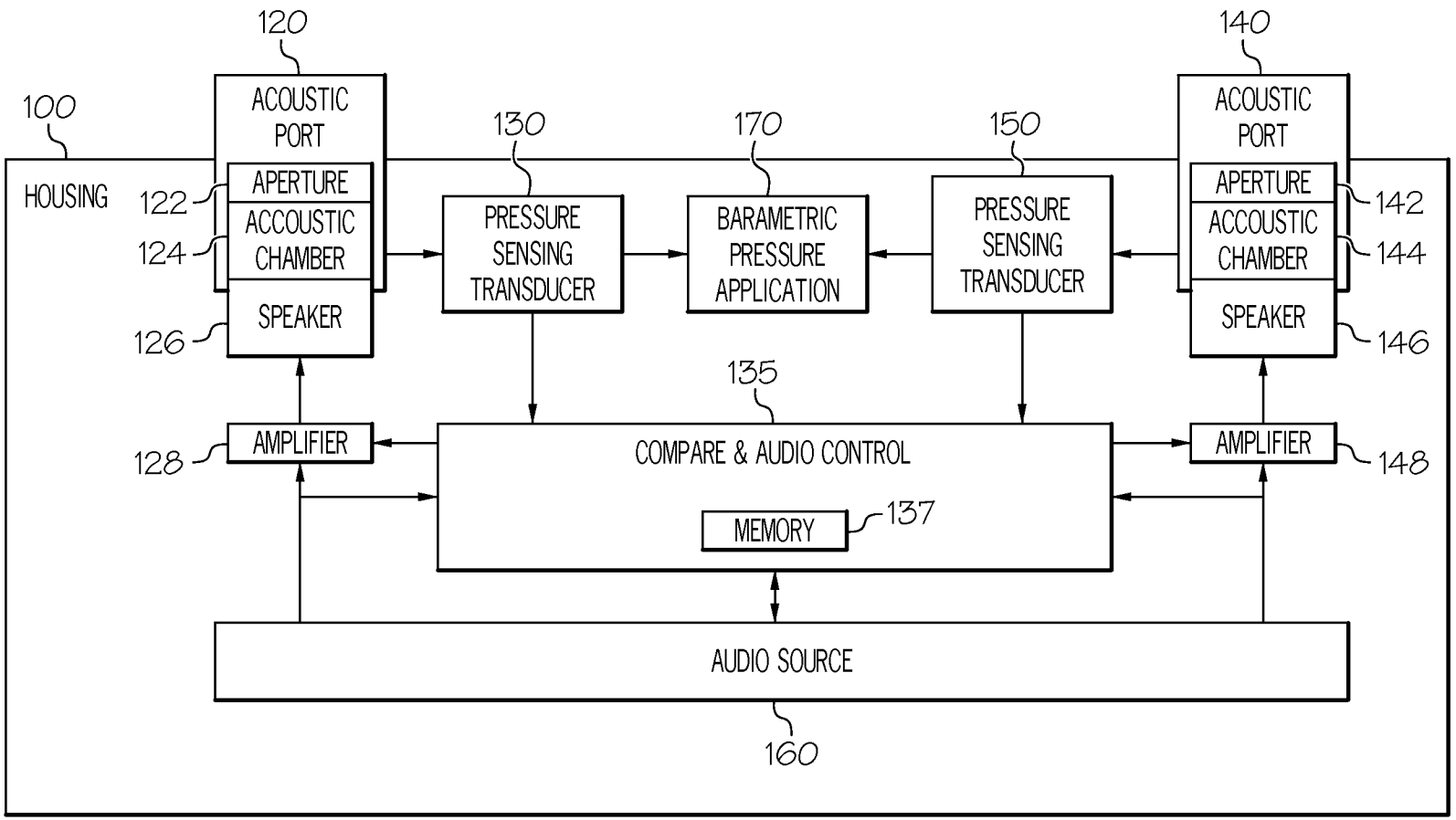
FIG. 1 illustrates a representative block diagram of an apparatus for altering an audio signal or an acoustic characteristic of an audio signal in response to an obstructed acoustic port.

As required, detailed embodiments are disclosed herein; however, it is to be understood that the disclosed embodiments are merely examples and that the systems and methods described below can be embodied in various forms. Therefore, specific structural and functional details disclosed herein are not to be interpreted as limiting, but merely as a basis for the claims and as a representative basis for teaching one skilled in the art to variously employ the disclosed subject matter in virtually any appropriately detailed structure and function. Further, the terms and phrases used herein are not intended to be limiting, but rather, to provide an understandable description.

The terms "a" or "an", as used herein, are defined as one or more than one. The term plurality, as used herein, is defined as two or more than two. The term another, as used herein, is defined as at least a second or more. The terms "including" and "having," as used herein, are defined as comprising (i.e., open language). The term "coupled," as used herein, is defined as "connected," although not necessarily directly. In the context of the following description, some components may be coupled communicatively, such that one may communicate with the other. In some cases, communicative coupling can be achieved by electrical coupling, in which one component may pass electrical signals to the other. In different contexts, some components may be coupled to one another mechanically or physically. In other contexts some components may be coupled acoustically for facilitating the transmission of sound, acoustic energy or acoustic pressure. The terms acoustically commutative or acoustically coupled are indicative of the transmission of sound, including sound traveling through a tube or resonant cavity or chamber. A speaker is acoustically coupled or acoustically communicative with a pressure sensing transducer if the pressure sensing transducer is able to produce a pressure signal responsive to the sound generated by the speaker. A speaker is acoustically coupled to or acoustically communicative with an acoustic port of a housing if sound generated by the speaker is radiated beyond the housing by the acoustic port. A speaker is acoustically coupled to or acoustically communicative with an aperture of an acoustic port of a housing if sound generated by the speaker is radiated beyond the housing through the aperture of the acoustic port. The term "configured to" describes hardware, software or a combination of hardware and software that is adapted to, set up, arranged, built, composed, constructed, designed or that has any combination of these characteristics to carry out a given function. The term "adapted to" describes hardware, software or a combination of hardware and software that is capable of, able to accommodate, to make, or that is suitable to carry out a given function. In the following discussion, "handheld" is used to describe items, such as "handheld devices," that are sized, shaped, designed or otherwise configured to be carried and operated while being held in a human hand.

Described below, in one example a method comprises determining a presence of an obstruction at an acoustic port, the acoustic port radiating acoustic pressure and altering generation of the acoustic pressure in response to the determination. The acoustic port includes a portion of a housing having an aperture (the aperture being acoustically coupled to a speaker within the housing) the speaker for generating the acoustic pressure within the housing and the aperture for radiating the acoustic pressure beyond the housing, and the determining includes detecting an increase in acoustic pressure within the housing with a pressure sensing transducer. The acoustic port further includes an acoustic chamber within the housing for acoustically coupling the speaker and the aperture, and the determining includes detecting an increase in acoustic pressure within the acoustic chamber. The pressure sensing transducer includes a barometer for generating a barometric pressure signal and the method further comprises processing the barometric pressure signal for at least one of estimating an altitude associated with the apparatus and estimating a change in weather. The speaker is driven by an audio signal from an audio source and the pressure sensing transducer generates a pressure signal wherein the method further includes comparing the audio signal with the pressure signal and the determining determines the presence of the obstruction in response to the comparing. The determining determines the presence of the obstruction in response to an increase in the pressure signal relative to the audio signal. The pressure sensing transducer includes a barometer for providing a pressure signal, and a barometric pressure application is responsive to the pressure signal, and in response to the speaker generating acoustic pressure, the method further includes processing the pressure signal by an audio control process for altering generation of the acoustic pressure, and inhibiting processing of the pressure signal by the barometric pressure application. The speaker is driven by an audio signal from an audio source and the pressure sensing transducer generates a pressure signal wherein the determining is made in response to a comparison between the audio signal and the pressure signal. The determination may be made in response to an increase in the pressure signal relative to the audio signal. The pressure sensing transducer generates a pressure signal and the determining is made in response to the pressure signal exceeding a threshold. The altering includes at least one of reducing an amount of energy used to generate the acoustic pressure and filtering a frequency component of the acoustic pressure. The method further comprises determining a removal of the presence of the obstruction and restoring generation of acoustic pressure, and altering generation of a second acoustic pressure of a second acoustic port in response to the determining. The altering of the generation of the acoustic pressure includes decreasing the acoustic pressure and the altering the generation of the second acoustic pressure includes increasing the second acoustic pressure. The acoustic pressure includes a first audio signal and the second acoustic pressure includes a second audio signal in response to a determined absence of the obstruction, and altering of the generation of the second acoustic pressure includes combining at least a portion of the first audio signal with the second audio signal. The method further comprises generating a first audio signal by an audio source, and generating a second audio signal by the audio source wherein the acoustic pressure is generated in response to the first audio signal, the second acoustic pressure is generated in response to the second audio signal, and the altering generation of the second acoustic pressure includes combining the second audio signal with at least a portion of the first audio signal.

In another example, an apparatus comprises a housing defining an acoustic port, a speaker enclosed within the housing, the speaker and the acoustic port cooperating to generate acoustic pressure and to radiate the acoustic pressure beyond the housing, a pressure sensing transducer for determining acoustic pressure within the housing and to generate a pressure signal as a function of the determining, and a controller configured to receive the pressure signal and to alter the generation of the acoustic pressure in response to the acoustic pressure signal. In another example, the apparatus comprises a housing having an acoustic port, a speaker enclosed within the housing and acoustically coupled to the acoustic port, the speaker for generating acoustic pressure and radiating the acoustic pressure through the acoustic port, a pressure sensing transducer for determining acoustic pressure within the housing, and a controller coupled to the speaker and the pressure sensing transducer for altering an acoustic characteristic of the acoustic pressure generated by the speaker in response to the acoustic pressure determined by the pressure sensing transducer. The pressure sensing transducer includes a barometer for producing a barometric pressure signal and the apparatus further comprises a barometric pressure processor or application coupled to pressure sensing transducer for processing the barometric pressure signal for at least one of estimating an altitude associated with the apparatus and estimating a change in weather. Altering the acoustic characteristic includes least one of reducing an amplitude and filtering a frequency component of the acoustic pressure generated by the speaker. The pressure sensing transducer can include a microphone. The apparatus further comprises an acoustic chamber for acoustically coupling the speaker to the acoustic port, and the pressure sensing transducer determines the acoustic pressure within the acoustic chamber. The housing defines an acoustic chamber, and the pressure sensing transducer determines the acoustic pressure within the housing by determining the acoustic pressure within the acoustic chamber. The housing has a second acoustic port and the apparatus further comprises a second speaker for generating a second acoustic pressure and radiating the second acoustic pressure through the second acoustic port, and further wherein the controller is coupled to the second speaker and alters an acoustic characteristic of the second acoustic pressure generated by the second speaker in response the acoustic pressure determined by the pressure sensing transducer.

In another example a non-transitory computer readable medium having a stored set of instructions that when executed cause an apparatus to determine a change in an acoustic pressure signal from a pressure sensing transducer sensing an acoustic pressure within a housing having an aperture acoustically coupled to a speaker for generating the acoustic pressure and alter an acoustic characteristic of the generated acoustic pressure in response the determining. Altering the acoustic characteristic includes at least one of reducing an amplitude and filtering a frequency component of the acoustic pressure generated by the speaker.

An aspect of the present description may advantageously provide an aperture (which may be a single aperture) for both radiating acoustic pressure and providing for a determination barometric pressure. A small number of apertures in a housing may increase the strength and robustness of the housing in situations such as impacts and drops, and may limit exposure of components within the housing to intrusion by environmental elements outside of the housing, such as dust and water. Further, the shared use of the aperture allows a barometer to be used for both barometric pressure reading and acoustic port obstruction detection. In other words, the barometer (or pressure sensing transducer) may be used for other purposes besides acoustic port obstruction detection, such as monitoring climate or estimating altitude. Furthermore, combining an acoustic port with a barometer port allows the housing to be smaller and thus lighter and may reduce the design complexity, cost and weight associated with the second port allowing for a smaller, lighter and lower cost product. The shared aperture configuration may also allow the barometer to be used to determine an obstruction of the acoustic port. The present description also provides a potential advantage of reducing wasted power consumption by altering generation of the acoustic pressure when the acoustic port is obstructed. When the sound is blocked, the energy expended generating the sound is reduced thereby reducing wasted power. The present description also may provide the advantage of enhancing the sound generated by the device when an acoustic port is blocked. Sound enhancements may include altering the frequency profile of the obstructed acoustic port, altering the volume of a second unobstructed acoustic port and switching the audio generation from stereo to mono.

FIG. 1 illustrates a representative block diagram of an apparatus for altering an acoustic characteristic of an audio signal in response to an obstructed acoustic port. As used herein, "altering an acoustic characteristic of an audio signal" may also be described interchangeably as "altering an acoustic characteristic of acoustic pressure" or "altering generation of acoustic pressure." An audio signal may be in any of several forms, including an analog electrical signal powering a speaker, an encoded electrical signal or optical signal or sound waves, and may change or be transduced from one form to another.

Housing 100 acts as a protective covering for a portable or a handheld electronic device radiating audio. Colloquially speaking, a device that radiates audio makes or emits sound such as speech, songs, music, alarms and the like. Radiating audio so that it may be heard by a user or otherwise detected, and may also be described as radiating acoustic pressure beyond the housing 100 of the device. Such devices may include pagers, personal digital assistants, e-readers, cellphones, smartphones, super phones, tablets, convertible PCs, laptops, gaming systems and other such devices. The radiated audio includes acoustic pressure such as sound waves emitted for annunciating sound such as telephone call voices, music, sound tracks for video, alert tones and ring tones.

The system has one or more acoustic ports having at least one speaker associated therewith. Acoustic port 120 typically includes one or more structures that cooperate with the speaker to generate acoustic pressure (generating acoustic pressure may be thought of as producing sound, or emitting sound including sound of good quality or fidelity). The speaker and the acoustic port 120 cooperate (function together) to generate acoustic pressure and to radiate or emit acoustic pressure beyond the housing. Acoustic port 120 includes a portion of the housing (that is, the housing or a part of the housing, in addition to other functions, may define one or more structures of acoustic port 120) having an aperture 122 or more than one aperture that allows acoustic pressure, including sound waves, generated by a speaker 126 to be radiated outside of the apparatus and beyond the housing thereby being heard by users within hearing range of the apparatus. In other words, sound or acoustic pressure from the speaker may be radiated from the speaker 126 through the acoustic port 120, and thereby be radiated beyond the housing. The sound may be, but need not be, radiated or emitted directionally.

The speaker 126 may be deemed to be enclosed within the housing in the sense that the speaker is not generally accessible to the user (in other words, saying that the speaker 126 is enclosed within the housing need not mean that the speaker 126 is completely enclosed within the housing). Generally speaking, an aperture represents one or more passages, channels or openings through which acoustic pressure may pass. Although an aperture may be conveniently discussed in terms of its location, dimension, shape and other qualities that allow acoustic pressure to pass, an aperture may also be discussed in terms of the structure or structures that define the aperture. Similarly, an acoustic chamber (discussed below) may be conveniently discussed in terms of location, dimension, shape and other qualities that affect acoustic pressure, and may also be discussed in terms of the structure or structures that define it.

The speaker is driven by an amplifier 128 and a controller 135 having a compare process and an audio control process which are used to control, alter, set, adjust, change or otherwise regulate one or more acoustic characteristics of the acoustic pressure or modify one or more acoustic characteristics of the speaker that generates the acoustic pressure. In other words, the acoustic pressure generated by the speaker may be altered, such as by altering the audio signal before it gets to the speaker or by altering the signal as it is transduced by the speaker or by altering the speaker as it transduces the signal. The altering is in response to (or is a function of) a determination of the presence of an obstruction at an acoustic port. Examples of acoustic characteristics that may be altered include the volume of the sound, one or more frequency components of the sound, one or more channels of the sound, the instantaneous pressure of the sound, the average or representative pressure of the sound over a time interval and other qualities or attributes of sound or a set of sounds. Altering generation of the acoustic pressure may include: setting, modifying, changing, shifting or filtering a frequency component the frequency spectrum of an audio signal provided to the speaker (the audio signal being provided or supplied to the speaker generally being in a form other than sound, such as an electrical or optical signal); setting, modifying, changing increasing or decreasing the amplitude or volume of the audio signal provided to the speaker; turning the speaker off; and setting, modifying or changing the information content of the audio signal provided to the speaker.

The speaker is in close proximity with the aperture and a pressure sensing transducer 130. Close proximity is not restricted to any particular range of distances, but in the case of handheld devices, items in close proximity are often a few millimeters apart or less. The close proximity acoustically couples the speaker, the aperture and the pressure sensing transducer within the housing. In one example, the speaker is mounted on a printed circuit board (PCB) and is located close to the aperture so that a large portion of the acoustic pressure or sound generated by the speaker is transmitted through the aperture to an environment outside of the housing. The pressure sensing transducer can be mounted on the same PCB and close to the speaker in order to sense the speaker acoustic energy present within the housing when the speaker is being driven by the audio signal. The pressure sensing transducer generates a pressure signal (or acoustic pressure signal) as a function of a determined (e.g., measured or sensed or detected) pressure. The pressure signal may be a function of the acoustic pressure within the housing or a structure defined by the housing, such as an acoustic chamber. The acoustic pressure signal generated by the pressure sensing transducer is then received by and processed by the controller 135.

The aperture also enables the interior of the housing to be kept at the atmospheric pressure of the surrounding environment. Atmospheric pressure is known to vary with altitude and changing weather conditions. The pressure sensing transducer also generates the barometric pressure signal for processing by a barometric pressure application 170 operating on the device. The barometric pressure application, which may be operated by a barometric pressure processor, may determine altitude and weather information and provide related information to the user or other applications operating within the apparatus. The barometric pressure processor may include one or more of a processor, a microprocessor, a DSP, an ASIC, analog circuitry, and software, firmware, code, computer code, instructions or computer instructions for implementing the barometric pressure application.

The acoustic port may also include an enclosure enclosing a space such as acoustic chamber 124 to acoustically couple the speaker and the aperture by routing sound from the speaker to the aperture. The acoustic chamber may be defined by the housing and may take the form or a tube, a cavity or other enclosed or semi-enclosed volume within the housing. The acoustic chamber may be acoustically tuned to enhance the sound heard by the users of the apparatus and to better acoustically isolate other components within the housing from acoustic pressures generated by the speaker. From another perspective, the acoustic chamber may be the interior of the housing. If there is an acoustic chamber isolating the acoustic coupling from the remaining interior of the housing, then the pressure sensing transducer may be located such that it measures the acoustic energy within the acoustic chamber.

While one example includes an implementation with a single acoustic port 120 with aperture 122, acoustic chamber 124 physically coupled to speaker 126 driven by amplifier 128 and generating acoustic pressure determined by pressure sensing transducer 130, other examples include implementations with multiple speakers with multiple ports. FIG. 1 shows an optional second acoustic port 140 having a second aperture 142 and a second acoustic chamber 144 coupled to a second speaker 146 driven by a second amplifier 148 which acoustic pressure generated by the second speaker and detected by second pressure sensing transducer 150. In other examples there may be more than one acoustic port coupled to a speaker or there may be more than one speaker coupled to an acoustic port or there may be many more acoustic ports and many more speakers than the example shown in FIG. 1. In other example implementations the second pressure sensing transducer may be eliminated: this may be advantageous if the second aperture comprised multiple apertures or if the structure of the aperture or its location on the housing reduces the likelihood of an obstruction degrading the audio produced by the port. As previously indicated, "obstructing" a port may include, but is not necessarily limited to, completely obstructing the acoustic port or its aperture. Generally speaking, a port may be obstructed when it is wholly or partially occluded, impeded, covered or otherwise blocked by one or more physical objects such that the quality of the audio is or may be adversely affected. Audio source 160 provides audio signals to the amplifiers which may include audio content such as alert indicators, voice and music audio information. Controller 135 receives acoustic pressure signals from the pressure sensing transducers, provides audio characteristic alteration signals to the amplifiers and the audio source.

When the aperture of the acoustic port is not obstructed, acoustic pressure generated by the speaker is effectively radiated about the apparatus. However, when an aperture is obstructed, the acoustic energy within the housing or acoustic chamber changes. An increase in acoustic pressure is indicative of an obstructed aperture. The increase in acoustic pressure resulting from an obstructed opening may manifest as, for example, an increase in pressure in comparison to a pressure of an unobstructed opening, or an increase in average pressure in comparison to an average pressure of an unobstructed opening, or an increase in peak pressure.

An obstructed aperture or acoustic port can result from any of situations. An obstruction partially or totally blocks sound radiated by the acoustic port resulting in a sound pressure increase within the housing and a decrease in volume and/or sound quality heard by a user. An obstructed aperture often results in a lower volume and muffled sound. An obstruction includes a partial or total blockage, hindrance or closing of the aperture. A common obstruction includes a port being covered while holding the apparatus when it is being hand held. Another type of obstruction results from the apparatus being kept within a holster or folio which does not have an aperture corresponding to the acoustic port apertures: the holster partially or completely blocks the sound radiated by the aperture. Yet another type of obstruction occurs when the apparatus is placed on a surface in such a way as to cover or block radiation of sound by the aperture. Many other ways of partially or totally obstructing the acoustic port are possible that increase the acoustic pressure within the housing.

An obstructed port results in undesirable characteristics. First, the sound quality produced by the apparatus may be degraded. The sound will typically be perceived as muffled. A reduced volume and/or a degraded frequency response. Also, the increase in sound pressure within the housing (which may manifest as an increase in pressure in the acoustic chamber) can cause audio non-linearities to be produced by the speaker, thereby further degrading the quality of sound generated by the device. Also, for devices having a restrained or finite power supply, such as battery powered devices, conserving power is important to enhance the operating time of the device between battery charges or battery replacement or other power replenishment. Expending large amounts of power on generating degraded audio signals generally does not facilitate extension of battery life, for example, and can in some circumstances result in increased internal heating.

Also, in implementations with multiple speakers with multiple acoustic ports, then energy expended producing sound at an obstructed port would be better applied to producing additional energy at an unobstructed port. Sound produced at an unobstructed port has better fidelity than sound produced at an obstructed port. Furthermore, if each acoustic port produces a different component of an intended sound reproduction experience, such as in stereo or surround-sound implementations, then an obstructed port may omit or attenuate a portion of the sound information while other portions may be produced unattenuated. For example, one of two stereo channels may be attenuated by the obstructed port while sound from the unobstructed port is not attenuated. Thus, if the acoustic characteristics of the device remained unaltered, only a portion of the intended audio content would be presented by the device even though one of the ports is not obstructed.

Controller 135 analyzes the signal from the pressure sensing transducer in order to determine if a port is obstructed and either alters an acoustic characteristic of the audio signal provided to the obstructed acoustic port, or alters an acoustic characteristic of an audio signal provided to an unobstructed port, or both. Alteration of an obstructed port audio signal may include for example reducing the amplitude of the audio signal, thereby reducing an amount of energy used to generate the acoustic pressure, or altering the frequency content of the audio signal. Altering the frequency content can include, for example, frequency-based filtering, which may amplify or attenuate distinct frequencies or ranges of frequencies, or frequency-shifting. Alteration to an unobstructed port audio signal, in response to an obstructed port may include, increasing the volume of the audio signal provided to the unobstructed port, thereby compensating for a reduction in volume from the obstructed acoustic port. Also, audio content from an obstructed acoustic port can be added to the audio content of the unobstructed acoustic port. In an example of a stereophonic signal, obstruction of one acoustic port would result in the decrease in volume of the signal produced by the speaker of the obstructed acoustic port combined with an increase in volume of the speaker of the unobstructed acoustic port and a combining of the audio signals of both stereo audio channels into the signal sent to the unobstructed acoustic port, thereby providing a mono signal to the unobstructed acoustic port instead of a stereo signal. The mono signal can optionally also be provided to the obstructed port at a reduced volume.

Upon detection of a removal of the obstruction, the audio characteristics of the speakers can be restored. That is, the alteration of the acoustic pressure that may have been performed in response to a determination that the acoustic port was obstructed may be discontinued when it is detected that the obstruction is no longer present.

An obstruction can be determined by detecting an increase in acoustic pressure by the pressure sensing transducer. In one example, the pressure sensing transducer is a barometer. In another example, the pressure sensing transducer can be any transducer, including a microphone. The increase in acoustic pressure may be determined by the signal from the pressure sensing transducer exceeding a threshold. The threshold may be absolute or may be varied with respect to the volume level set by the controller. The threshold may be a single value, a value representative of a group of values (such as an average) or a range of values. In a fixed threshold example, if acoustic pressure exceeds a fixed threshold corresponding to a preset sound pressure level threshold, a level of 120 dB for example, then the acoustic port may be considered blocked or smothered. This results in a determining of a presence of an obstruction at an acoustic port. In another example, the volume setting of the apparatus may be considered when determining the threshold. By way of example, the threshold may be 80 dB at a low volume setting and correspondingly increase with dB increases in the volume setting of the system. In another example, a significant increase in acoustic pressure without a corresponding increase in volume may be used to detect an obstructed acoustic port. In another example, controller 135 can compare energy in the audio signal provided to the speaker with the pressure signal generated by the pressure sensing transducer to determine an obstruction.

Memory 137 of controller 135 may store the thresholds. Also, controller 135 may include a microprocessor, computer, digital signal processor and/or application specific integrated circuit for implementing the methods and processes described herein, and memory 137 may operate as a non-transitory computer readable medium for storing instructions for implementing methods and processes described herein.

Figure 2:
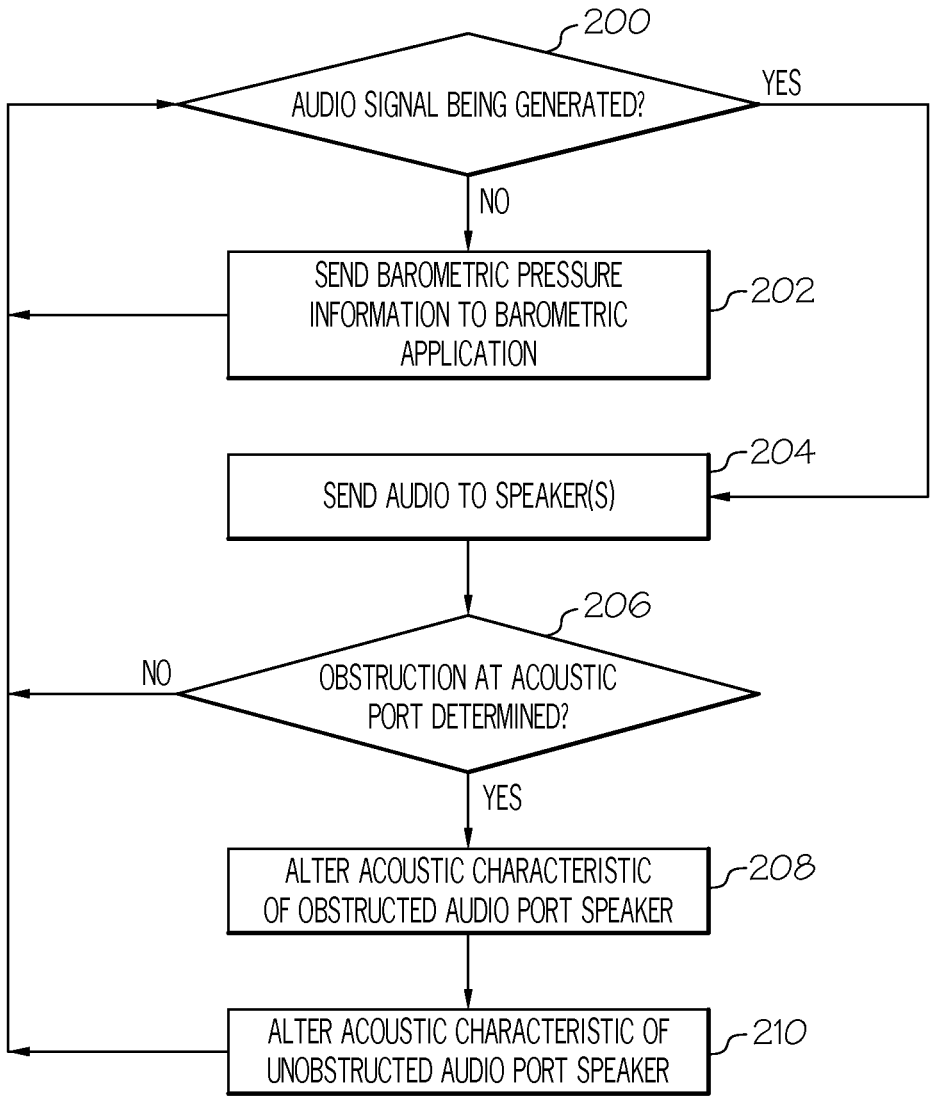
FIG. 2 illustrates a flow diagram for an apparatus for determining an obstructed acoustic port and for altering an acoustic characteristic of an audio signal in response thereto.

FIG. 2 illustrates a flow diagram for an apparatus for determining an obstructed acoustic port and for altering an acoustic characteristic of an audio signal in response to the determination. Step 200 determines if an audio signal is being generated by audio source 160. If not, then barometric pressure information is sent to barometric pressure application 170. Otherwise, audio information is sent to the speakers at step 204 and step 202 is not executed. This has the effect of inhibiting processing of the pressure signal by the barometric pressure application in response to the speaker generating acoustic pressure. If an obstructed port is not detected at step 206 then the flow diagram returns to step 200. If an obstructed port is detected, then step 208 alters an acoustic characteristic of the obstructed acoustic port speaker. In a multiple speaker and multiple acoustic port implementation, step 210 alters an acoustic characteristic of an unobstructed acoustic port speaker. It should be appreciated that in multiple acoustic port, multiple speaker implementations, alternate examples may only implement either step 208 or step 210. Implementing only step 208 has the advantage of at least one of conserving power, reducing a buildup of internal heat and potentially improving the sound experience produced by the apparatus by reducing the muffled or smother sound resulting from an obstructed port. Implementing only step 210 improves the sound experience produced by the apparatus by compensating for the reduced volume of the obstructed port with increased volume or signal content of the unobstructed port.

Figure 3:
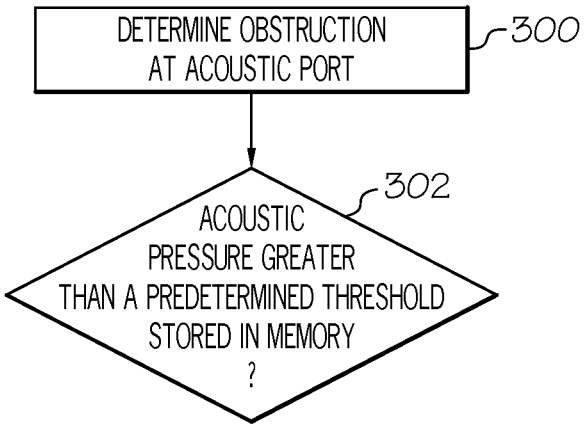
FIG. 3 illustrates a representative example for determining an obstruction at an acoustic port.

FIG. 3 illustrates a representative example for determining an obstruction at an acoustic port. The processes of FIG. 3 corresponds to step 206 of FIG. 2. Step 302 detects an increase in acoustic pressure within the housing with a pressure sensing transducer and determines if the acoustic pressure sensed by the pressure sensing transducer associated with the acoustic port is greater than a predetermined threshold stored in memory. As previously discussed, the threshold may be fixed or may vary with volume setting of the apparatus.

Figure 4:
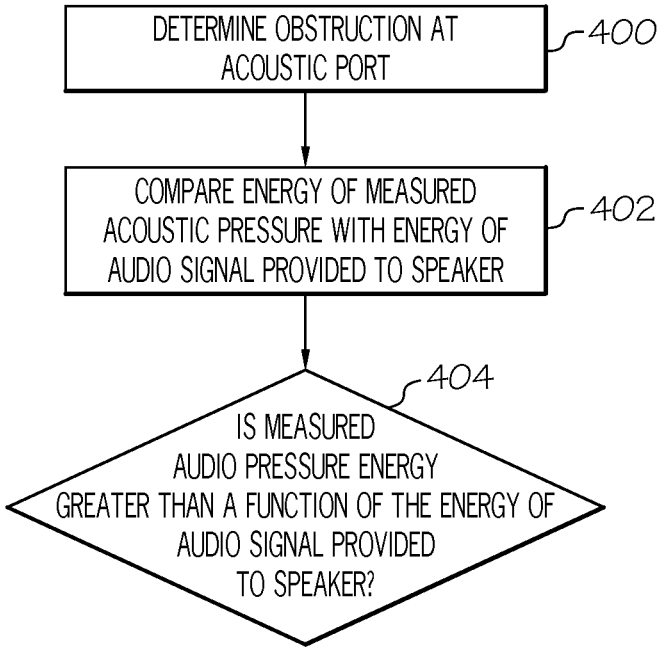
FIG. 4 illustrates another representative example for determining an obstruction at an acoustic port.

FIG. 4 illustrates another representative example for determining an obstruction at an acoustic port. The processes of FIG. 4 correspond to step 206 of FIG. 2. Step 402 detects an increase in acoustic pressure within the housing with a pressure sensing transducer, determines the energy of the measured acoustic pressure and compares it with the energy of the audio signal provided to the speaker. This corresponds to comparing the audio signal with the pressure signal. Step 404 determines if the measured energy is greater than a function of the energy signal provided to the speaker. Thus, the presence of the obstruction is determined in response to an increase in the pressure signal relative to the audio signal. For example, in an unobstructed acoustic port, a speaker generating an 80 dB audio signal one meter from the apparatus will result in an audio signal having a first determined energy level and first sound pressure energy level within the housing or acoustic chamber. If the acoustic port is obstructed, a second sound pressure energy level will be determined, the second sound pressure level being greater than the first. An obstruction may be determined by detecting this increase. The increase is the function of the energy of the audio signal provided to the speaker and may be of an order of a 20 dB increase in expected acoustic pressure energy relative to an unobstructed audio port. In other implementations, the value of 20 dB may be increased or decreased. The values used herein are by way of example only and the function may be varied while remaining within the scope of the disclosure.

Other methods may also be used to process the pressure signal and/or the audio signal while remaining within the scope of the disclosure. Other methods may include more complex calculation and a wider array of data related to current and past pressure signal readings and current and past audio signal readings. More complex calculations include first, second and third order integrals or derivatives of the pressure signal and/or the audio signal to determine if the acoustic port is obstructed.

Figure 5:
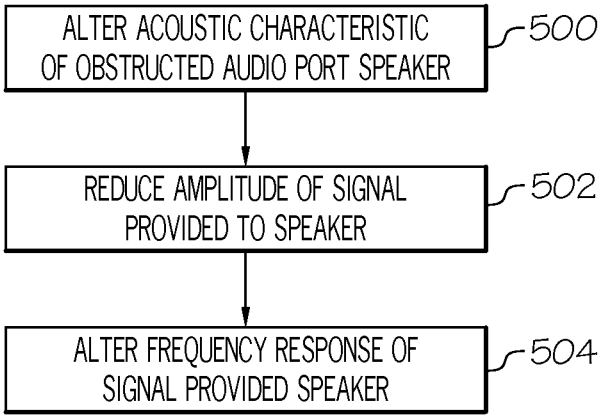
FIG. 5 illustrates a representative example for altering an acoustic characteristic of an obstructed port audio signal.

FIG. 5 illustrates a representative example for altering an acoustic characteristic of an obstructed acoustic port speaker. The processes of FIG. 5 correspond to step 208 of FIG. 2. Step 502 reduces the amplitude of the audio signal provided to the speaker associated with the obstructed port thereby reducing an amount of energy used to generate the acoustic pressure. In one example, the amplitude of the audio signal can be reduced to a point where the speaker is OFF. In another example, the amplitude can be reduced to a point where the sound is minimized yet providing a sufficient sound level to detect removal of the obstruction. Step 504 optionally reduces the frequency response of the signal provided to the speaker or filters a frequency component of the acoustic pressure. In one example of step 504, since generating lower frequency components of audio signals consumes more power than the higher frequency components, then step 504 may reduce the amplitude of the lower frequency components relative to the higher frequency components. Indeed the higher frequency components, above three kilohertz for example, may not be attenuated at all while lower frequency components, below one kilohertz for example, may be almost completely attenuated. This provides for a significant reduction in power consumption while still providing some audio content to the obstructed port which may be heard by the user. Furthermore, elimination of lower frequency components may produce a more pleasant listening experience from the sound resulting from an obstructed port.

Figure 6:
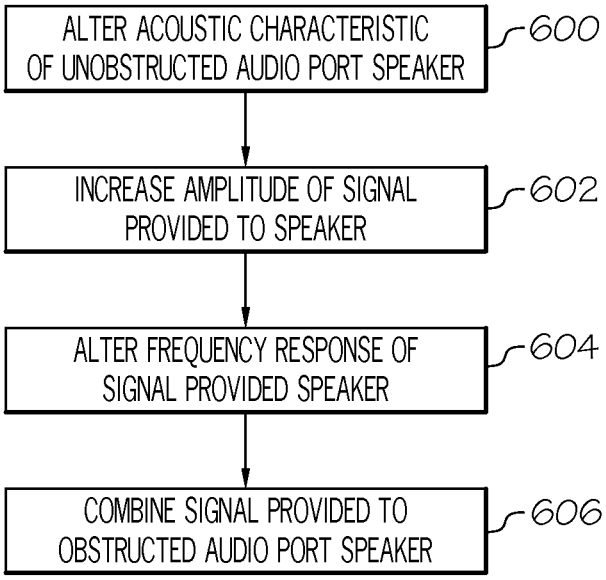
FIG. 6 illustrates a representative example for altering an acoustic characteristic of an unobstructed acoustic port audio signal.

FIG. 6 illustrates a representative example for altering generation of an acoustic characteristic of an unobstructed acoustic port speaker. The processes of FIG. 5 correspond to step 210 of FIG. 2. Step 602 increases the amplitude of the audio signal of the speaker associated with the unobstructed port, thereby increasing the acoustic pressure of the unobstructed port. This compensates for the amplitude decrease in audio produced by the apparatus resulting from the obstructed port. Step 604 alters the frequency response of the audio signal provided to the speaker, and step 606 combines information from the signal intended for the obstructed port speaker to the unobstructed port speaker. Thus, a first audio signal is generated by an audio source, and a second audio signal is generated by the audio source wherein the acoustic pressure of the obstructed audio signal is generated in response to the first audio signal, the acoustic pressure of the unobstructed port is generated in response to the second audio signal, and the altering generation of the acoustic pressure of the unobstructed in response to a detection of an obstruction of the obstructed port includes combining the second audio signal with at least a portion of the first audio signal. In an example of a stereo system, this step would provide a mono signal to the speaker of the unobstructed acoustic port while quieting the speaker of the obstructed acoustic port, thereby providing a full audio content experience even though one of the stereo speakers of the stereo system is obstructed. Alternately the only a portion of the first audio signal need be combined. For example, if the obstructed port were transmitting higher frequency components of the first audio signal, then in one example only a portion of the first audio signal having the lower frequency components of the first audio signal are combined with the second audio signal sent to the unobstructed port.

Figure 7:
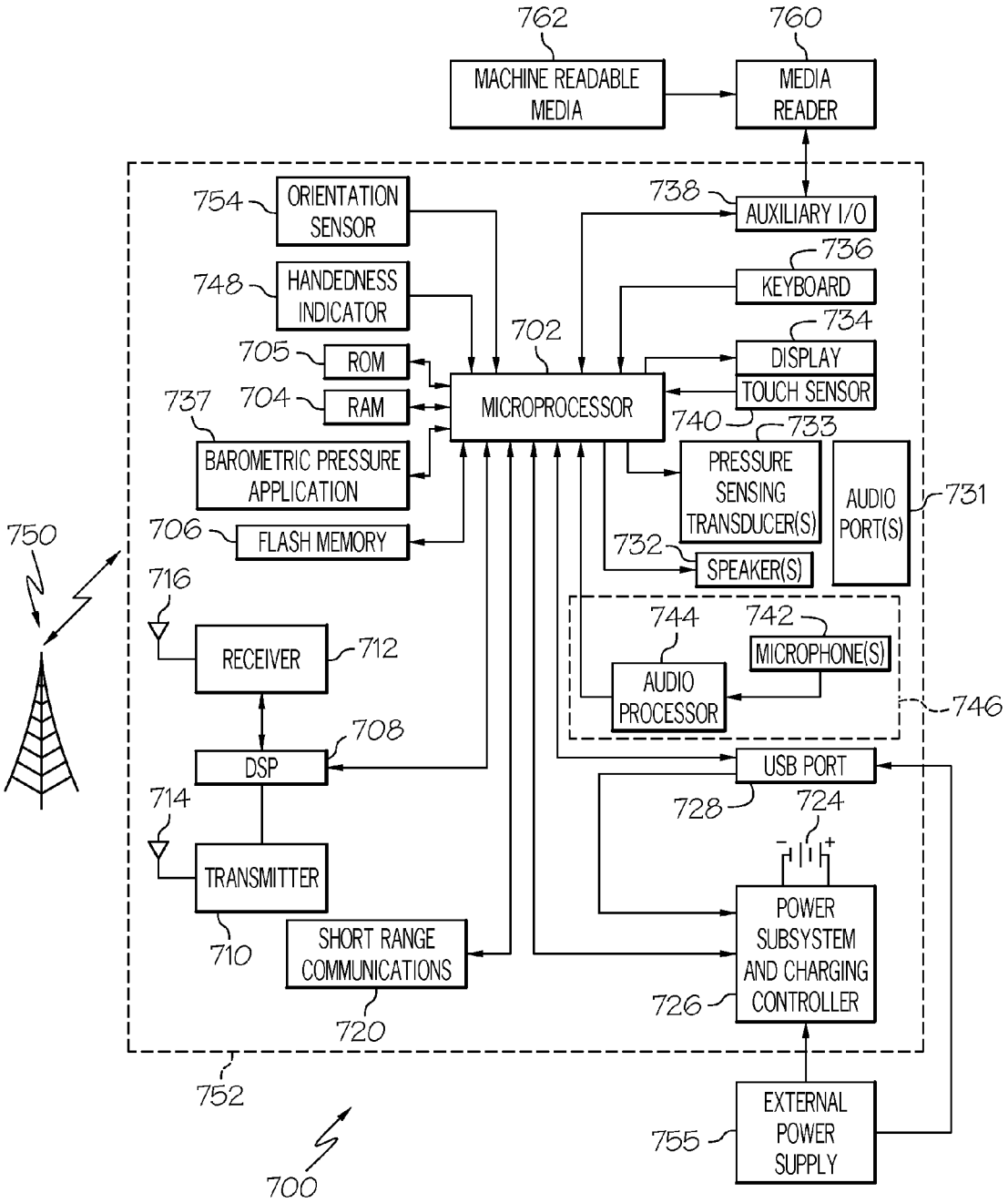
FIG. 7 illustrates a representative block diagram of an electronic device and associated components.

FIG. 7 illustrates a representative block diagram of an electronic device and associated components 700 that are able to include the above described systems and perform the above described methods. In this example, an electronic device 752 is a wireless two-way communication device, such as a smartphone, with voice and data communication capabilities. Such electronic devices communicate with a wireless network 750, which is able to include a wireless voice network, a wireless data network, or both, that use one or more wireless communications protocols. Wireless voice communications are performed using either an analog or digital wireless communication channel. Data communications allow the electronic device 752 to communicate with other computer systems via the Internet. Examples of electronic devices that are able to incorporate the above described systems and methods include, for example, a data messaging device, a two-way pager, a cellular telephone with data messaging capabilities, a wireless Internet appliance or a data communication device that may or may not include telephony capabilities.

The illustrated electronic device 752 is an example electronic device that includes two-way wireless communications functions. Such electronic devices incorporate a wireless communication component that includes a wireless communications subsystem including elements such as a wireless transmitter 710, a wireless receiver 712, and associated components such as one or more antenna elements 714 and 716. A digital signal processor (DSP) 708 performs processing to extract data from received wireless signals and to generate signals to be transmitted. The particular design of the communication subsystem is dependent upon the wireless communications network and associated wireless communications protocols with which the device is intended to operate.

The electronic device 752 includes a microprocessor 702 that controls the overall operation of the electronic device 752. The microprocessor 702 interacts with the above described communications subsystem elements and also interacts with other device subsystems such as flash memory 706, random access memory (RAM) 704, read only memory (ROM) 705 which is a non-transitory computer readable media device including computer instructions, stored instructions and/or a stored set of instruction, auxiliary input/output (I/O) device 738, USB Port 728, display 734, touch sensor 740, keyboard 736, pressures sensing transducers(s) 731 and speaker(s) 732 coupled to acoustic port(s) 733, audio processor 744, a short-range communications subsystem 720, an orientation sensor 754, a handedness indicator 748, a power subsystem and charging controller 726, and any other device subsystems.

The electronic device 752 in one example further includes an orientation sensor 754. Various electronic devices are able to incorporate one or more orientation sensors that include, for example, accelerometer or gyroscope based orientation sensors, light sensors that are located at locations on a case of the electronic device. In some examples, the orientation sensor produces an indication of the current orientation of the electronic device relative to the ground.

The electronic device 752 in one example includes an audio subsystem 746 that includes an audio processor 744, and a plurality of microphones 742. The audio processor 744 may be an ASIC, FPGA or DSP or other type integrated circuit.

A power pack 724 is connected to a power subsystem and charging controller 726. The power pack 724 provides or supplies power to the circuits of the electronic device 752. The power subsystem and charging controller 726 includes power distribution circuitry for providing power to the electronic device 752 and also contains power pack charging controller circuitry to manage recharging the power pack 724. By way of example, the power pack includes a rechargeable battery for making device 752 a battery operated device.

The USB port 728 provides data communication between the electronic device 752 and one or more external devices. Data communication through USB port 728 enables a user to set preferences through the external device or through a software application and extends the capabilities of the device by enabling information or software exchange through direct connections between the electronic device 752 and external data sources rather than through a wireless data communication network. The software exchange can be with microprocessor 702 or audio processor 744 or both as circumstances require.

Operating system software used by the microprocessor 702 is stored in flash memory 706 and/or ROM 705. Further examples are able to use a power pack backed-up RAM or other non-volatile storage data elements to store operating systems, other executable programs, or both. The operating system software, device application software, or parts thereof, are able to be temporarily loaded into volatile data storage such as RAM 704. Data received via wireless communication signals or through wired communications are also able to be stored to RAM 704.

The microprocessor 702, in addition to its operating system functions, is able to execute software applications on the electronic device 752. A predetermined set of applications that control basic device operations, including at least data and voice communication applications, is able to be installed on the electronic device 752 during manufacture. Examples of applications that are able to be loaded onto the device may be a barometric pressure application 737 or a personal information manager (PIM) application having the ability to organize and manage data items relating to the device user, such as, but not limited to, e-mail, calendar events, voice mails, appointments, and task items. Barometric pressure application may determine altitude or weather conditions and display the results on display 734. The altitude data may also supplement or complement altitude data determined by a global position system (GPS) application.

Further applications may also be loaded onto the electronic device 752 through, for example, the wireless network 750, an auxiliary I/O device 738, USB port 728, short-range communications subsystem 720, or any combination of these interfaces. Such applications are then able to be installed by a user in the RAM 704 or a non-volatile store for execution by the microprocessor 702.

In a data communication mode, a received signal such as a text message or web page download is processed by the communication subsystem, including wireless receiver 712 and wireless transmitter 710, and communicated data is provided the microprocessor 702, which is able to further process the received data for output to the display 734, or alternatively, to an auxiliary I/O device 738 or the USB port 728. A user of the electronic device 752 may also compose data items, such as e-mail messages, using the keyboard 736, which is able to include a complete alphanumeric keyboard or a telephone-type keypad, in conjunction with the display 734 and possibly an auxiliary I/O device 738. Such composed items are then able to be transmitted over a communication network through the communication subsystem.

For voice communications, overall operation of the electronic device 752 is substantially similar, except that received signals are generally provided to a speaker 732 and signals for transmission are generally produced by at least one of the plurality of microphones 742. Alternative voice or audio I/O subsystems, such as a voice message recording subsystem, may also be implemented on the electronic device 752. Although voice or audio signal output is generally accomplished primarily through the speaker(s) 732, the display 734 may also be used to provide an indication of the identity of a calling party, the duration of a voice call, or other voice call related information, for example.

Depending on conditions or statuses of the electronic device 752, one or more particular functions associated with a subsystem circuit may be disabled, or an entire subsystem circuit may be disabled. For example, if the power pack temperature is high, then voice functions may be disabled, but data communications, such as e-mail, may still be enabled over the communication subsystem.

A short-range communications subsystem 720 is a further optional component which may provide for communication between the electronic device 752 and different systems or devices, which need not necessarily be similar devices. For example, the short-range communications subsystem 720 may include an infrared device and associated circuits and components or a Radio Frequency based communication module such as one supporting Bluetooth® communications, to provide for communication with similarly-enabled systems and devices.

A media reader 760 is able to be connected to an auxiliary I/O device 738 to allow, for example, loading computer readable program code of a computer program product into the electronic device 752 for storage into flash memory 706 or in memory of audio processor 744. One example of a media reader 760 is an optical drive such as a CD/DVD drive, which may be used to store data to and read data from a computer readable medium or storage product such as computer readable storage media 762. Examples of suitable computer readable storage media include optical storage media such as a CD or DVD, magnetic media, or any other suitable data storage device. Media reader 760 is alternatively able to be connected to the electronic device through the USB port 728 or computer readable program code is alternatively able to be provided to the electronic device 752 through the wireless network 750.

Information Processing System

The present subject matter can be realized in hardware, software, or a combination of hardware and software. A system can be realized in a centralized fashion in one computer system, or in a distributed fashion where different elements are spread across several interconnected computer systems. Any kind of computer system, or other apparatus adapted for carrying out the methods described herein, is suitable. A typical combination of hardware and software could be a general purpose computer system with a computer program that, when being loaded and executed, controls the computer system such that it carries out the methods described herein.

The present subject matter can also be embedded in a computer program product, which comprises all the features enabling the implementation of the methods described herein, and which, when loaded in a computer system, is able to carry out these methods. Computer program in the present context means any expression, in any language, code or notation, of a set of instructions intended to cause a system having an information processing capability to perform a particular function either directly or after either or both of the following a) conversion to another language, code or, notation; and b) reproduction in a different material form.

Each computer system may include, inter alia, one or more computers and at least a computer readable medium allowing a computer to read data, instructions, messages or message packets, and other computer readable information from the computer readable medium. The computer readable medium may include computer readable storage medium embodying non-volatile memory, such as read-only memory (ROM), flash memory, disk drive memory, CD-ROM, and other permanent storage. Additionally, a computer medium may include volatile storage such as RAM, buffers, cache memory, and network circuits. Furthermore, the computer readable medium may comprise computer readable information in a transitory state medium such as a network link and/or a network interface, including a wired network or a wireless network, which allow a computer to read such computer readable information.

Non-Limiting Examples

Although specific embodiments of the subject matter have been disclosed, those having ordinary skill in the art will understand that changes can be made to the specific embodiments without departing from the scope of the disclosure. The scope of the disclosure is not to be restricted, therefore, to specific embodiments or examples, and it is intended that the appended claims define the scope of the present disclosure.

What is claimed is:

1. A method comprising:

operating a portable electronic device with at least a first acoustic port with a first portion of a housing having a first aperture, a first speaker, a first acoustic pressure sensor, and a first acoustic chamber for radiating a first acoustic pressure beyond the housing, and a second acoustic port with a second portion of a housing has a second aperture, a second speaker, a second acoustic pressure sensor, and a second acoustic chamber for radiating a second acoustic pressure beyond the housing;

determining a presence of an obstruction of the second acoustic port by detecting an increase in acoustic pressure with the second acoustic sensor; and altering generation of the first acoustic pressure in response to the determination of the obstruction the second acoustic port.

2. The method according to claim 1 wherein the second acoustic pressure sensor includes further includes a barometer for generating a barometric pressure signal and the method further comprises processing the barometric pressure signal for at least one of estimating an altitude and estimating a change in weather, and the altering generation of the first acoustic pressure in response to the determination the obstruction of the second acoustic port includes inhibiting processing of a pressure signal from the second acoustic pressure sensor.

3. The method according to claim 1 wherein the second pressure sensing transducer generates a pressure signal and the determining is made in response to the pressure signal exceeding a threshold.

4. The method according to claim 1 wherein the altering includes at least one of reducing an amount of energy used to generate the second acoustic pressure and filtering a frequency component of the second acoustic pressure.

5. The method according to claim 1 further comprising:

determining a removal of the presence of the obstruction; and restoring generation of the first acoustic pressure.

6. The method according to claim 1 further comprising altering generation of the second acoustic pressure of the second acoustic port in response to the determining.

7. The method according to claim 6 wherein the altering of the generation of the second acoustic pressure includes decreasing the second acoustic pressure and the altering the generation of the first acoustic pressure includes increasing the first acoustic pressure.

8. The method according to claim 6 further comprising:

generating a first audio signal by an audio source, and generating a second audio signal by the audio source wherein the first acoustic pressure is generated in response to the first audio signal, the second acoustic pressure is generated in response to the second audio signal, and the altering generation of the second acoustic pressure includes combining the second audio signal with at least a portion of the first audio signal.

9. The method according to claim 1, wherein the first speaker is radiating a first acoustic pressure of a first channel of a multichannel audio signal, and the second speaker is radiating a second acoustic pressure of a second channel of the multichannel audio signal, and the altering generation of the first acoustic pressure in response to the determination of the obstruction the second acoustic port includes switching the first channel of multichannel audio to a mono signal.

* * * * *